US006170409B1

(12) United States Patent
Smith

(10) Patent No.: US 6,170,409 B1
(45) Date of Patent: Jan. 9, 2001

(54) TABLES FOR MACHINE UNITS

(75) Inventor: Howard Jameson Smith, Manchester (GB)

(73) Assignee: Brother Industries, Ltd. (JP)

( * ) Notice: Under 35 U.S.C. 154(b), the term of this patent shall be extended for 0 days.

(21) Appl. No.: 09/323,721

(22) Filed: Jun. 1, 1999

(30) Foreign Application Priority Data

Jun. 2, 1998 (GB) ..... 9811772

(51) Int. Cl.[7] ..... A47B 11/00
(52) U.S. Cl. ..... 108/143; 108/50.11
(58) Field of Search ..... 180/141, 138, 180/143, 147, 64, 65, 73, 50.11

(56) References Cited

U.S. PATENT DOCUMENTS 2,991,138 * 7/1961 Freeman ..... 108/141
3,397,411 * 8/1968 Rossi ..... 108/141 X
5,363,774 * 11/1994 Anada et al. ..... 108/143
5,468,101 * 11/1995 Shoda ..... 108/143 X
5,533,844 * 7/1996 Ekleberry ..... 108/143 X
5,697,686 * 12/1997 Miller et al. ..... 108/143 X

FOREIGN PATENT DOCUMENTS

1259414 * 3/1961 (FR) ..... 108/143

* cited by examiner

*Primary Examiner*—Jose V. Chen
(74) *Attorney, Agent, or Firm*—Barlow, Josephs & Holmes, Ltd.

(57) ABSTRACT

A table is disclosed for use in connection with a machine unit such as a multi-head embroidery machine. The table surface is slidably mounted to a slide unit mounted on a sub frame that is vertically movable between an upper position where the table can support a flat work piece to be sewn at the head of the machine, and a lower position where tubular pieces can be freely hand sewn freely from the machine head. The table is moved between the upper and lower positions by hydraulic cylinders that raise and lower the sub frame unit. The table can also be retracted into the main frame of the machine unit by means of a slide unit attached between the table and the sub frame.

10 Claims, 5 Drawing Sheets

TABLES FOR MACHINE UNITS

BACKGROUND OF THE INVENTION

The present invention relates to tables for machine units and in particular but not exclusively to, support tables for multi head embroidery machines.

Machine units such as multi head embroidery machines typically have between six to eighteen heads for sewing flat pieces of material supported on a table attached to the machine unit. In order for the machine unit to sew, for example, tubular work pieces it is necessary to lower the table in order to allow the work piece to hang more freely from the respective head.

In a conventional six head embroidery machine the support table typically weights 200 kg and is provided in four separate sections each of which is mounted on support brackets bolted to the machine unit. In order to move each section of the table to the lower position each section must be manually unfastened from its support mounting, respective spacing bracket removed and each section physically lifted upwards to disconnect from its mounting and then physically lowered to its lower position where it is once again fastened to the machine unit.

In a typical day it may be necessary to adjust the position of the table two or three times to allow for different production runs. This has the drawback that moving the table is a time consuming process resulting in downtime for the production line. Also, the lifting of the table is physically demanding due to the size and weight of each table section leading to operator fatigue and increased risk of operator injury whilst handling the table.

In larger machine units, for example having eighteen heads, it is known to move the table between its upper and lower position by expensive powered lifting means. This type of system still has the drawback that the table provides a large surface area for support of a flat work piece when the table is in the upper position, therefore when the table is moved to the lower position the operator must lean across this support area to place a tubular style work piece over a respective hoop at a head. This makes it difficult or the operator to correctly position the work piece and can lead to increased operator fatigue and strain. This drawback is also present in machine units in which the position of the table is manually adjusted.

SUMMARY AND GENERAL DESCRIPTION OF THE INVENTION

It is an object of the present invention to overcome or alleviate the above described drawbacks. Other objects, features and advantages of the invention shall become apparent as the description thereof proceeds when considered in connection with the accompanying illustrative drawings.

In accordance with one aspect of the present invention there is provided a table forming a support for a substantially flat work piece to be sewn at a work area of a machine unit, the table having a supporting structure with means to vertically adjust the height of the table and to horizontally retract the table at least partially away from said work area. This has the advantage that the table can be lowered from the work area to allow tubular work pieces to be sewn and that the table can be retracted to provide more room for the operator to place the tubular work pieces in the work area.

In accordance with a second aspect of the present invention there is provided a table forming a support for a substantially flat work piece at a sewing head of a machine unit, the table having a supporting structure with means to horizontally retract the table at least partially from the work area. This has the advantage that the support surface for the work piece can be reduced in size when smaller items are to be sewn whilst allowing the operator easier access to the work area. The table can also be retracted fully from the work area to allow tubular items to be attached at the work area.

Preferably, the means to retract is a slide unit. This allows the table to be retracted simply by pushing on the table. The slide unit could be fitted with linear ball slides.

Preferably, means are provided to selectively lock the table in a desired position. This prevents accidental movement of the table. The locking means could be a slide bolt mounted to the machine unit and engageable with a recess in the table.

Preferably the means to adjust the height of the table is a handle operated hydraulic lifting system. This is a cheap and convenient means for raising and lowering the heavy table structure.

Preferably, the table is mounted on a sub frame which is raised and lowered by the means for adjusting the height of the table and the means for retracting the table is mounted on the sub frame. In a preferred embodiment, the table is at least partially retractable into the machine unit when the table is in a lower position. This has the advantage that the table can be firstly lowered to allow tubular work pieces to be sewn and retracted to allow the operator easier access.

Preferably the table is mounted on the machine unit.

In a preferred embodiment, the machine unit is a six head embroidery machine

In a further preferred embodiment the table comprises several panels and the means for retracting can be selectively operated to independently move one or more panels. Preferably, the means for vertically adjusting the height can be selectively operated to independently move one or more panels. This allows a single machine unit having several heads to simultaneously sew flat or tubular pieces depending on position of the various panels.

BRIEF DESCRIPTION OF THE DRAWINGS FIGURES

By way of example only, specific embodiments of the present invention will now be described, with reference to the accompanying drawings, in which.

DETAILED DESCRIPTION OF THE PREFERRED EMBODIMENTS

Figure 2:
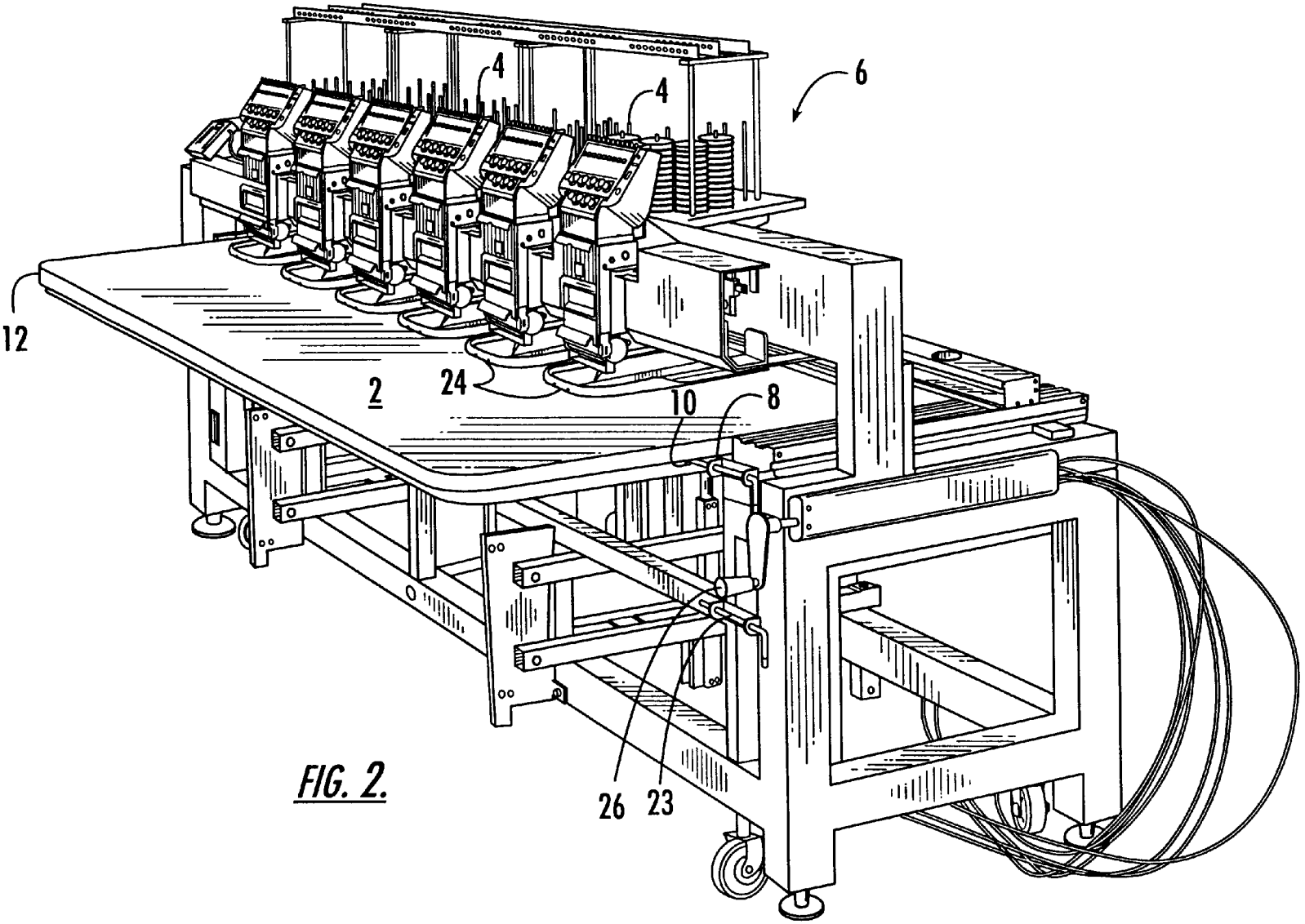
FIGS. 2 to 4 are perspective views of the table in combination with a six head embroidery machine unit with the table in an upper position, a lower intermediate position, and a lower retracted position respectively.

In FIG. 2, a table 2 is illustrated in an upper position whereat it can support a flat work piece (not illustrated) to be sewn or embroidered at one or more of the six heads 4 of the embroidery machine 6. The table is locked in place via a slide bolt 8 engaging in a recess 10 in the side 12 of the table 2. A similar slide bolt (not illustrated) is provided at the opposite side of the table.

Figure 1:
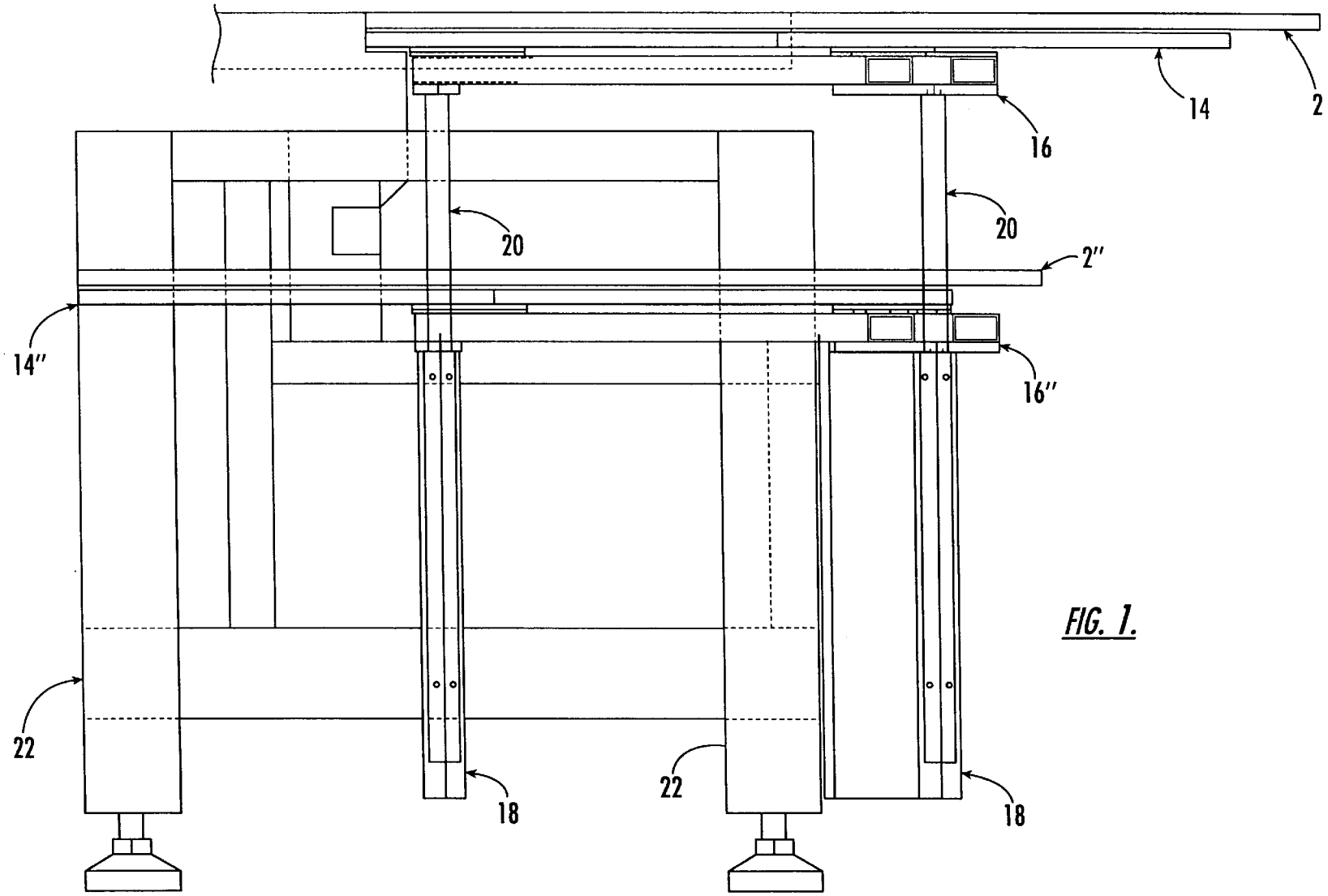
FIG. 1 is a schematic view of a table constructed in accordance with one embodiment of the present invention, illustrating the table in an upper position and a lower retracted position.

As best illustrated in FIGS. 1 and 2, the table 2 is connected to a slide unit 14 mounted on a sub-frame 16 supported by cylinder mounting bracket 18. In the upper position of the table 2, the sub frame 16 is held in place by respective hydraulic cylinders 20 extending out of the mounting bracket 18.

Figure 3:
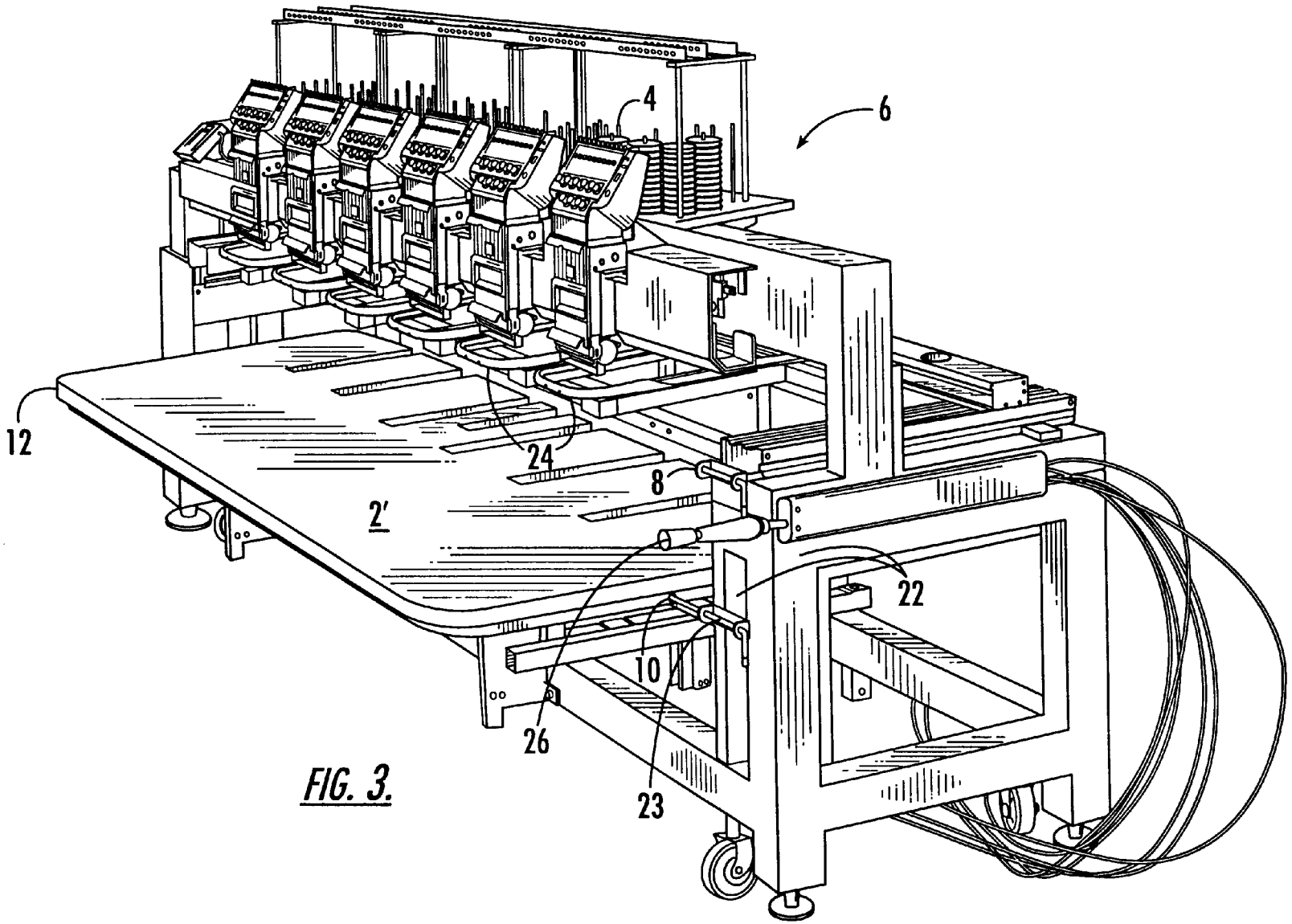
Figure 4:
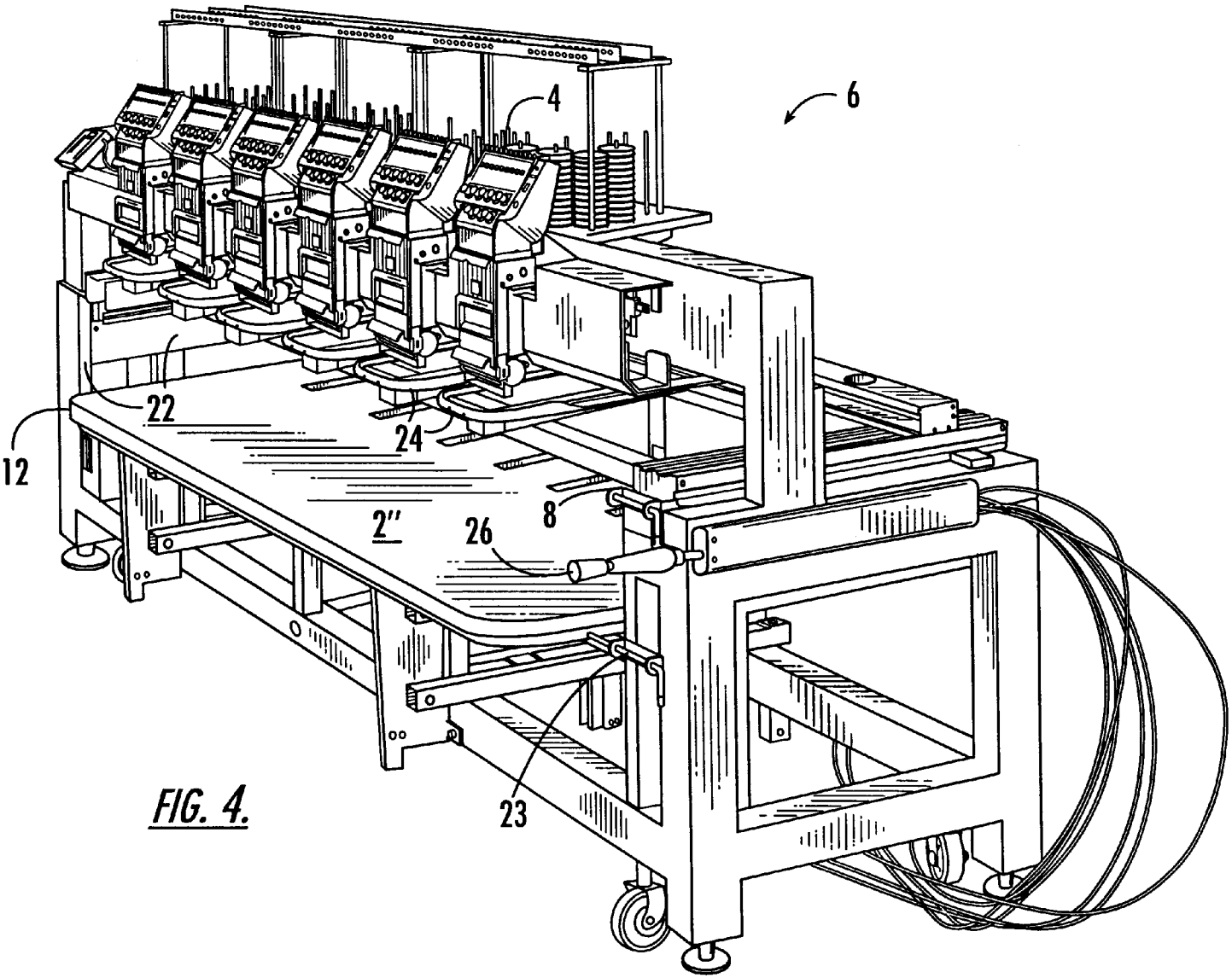

In order to lower the table to the intermediate position illustrated in FIG. 3 the slide bolt 8 is withdrawn from recess 10 to unlock the table 2, the hydraulic cylinders 20 are retracted into the mounting brackets 18 lowering the table 2, supported on the sub frame 16, to its lower intermediate position 2'. In this position the table 2' still protrudes out of the machine unit main frame 22. The table 2' is then partially retracted into the machine frame 22 by pushing on the table and sliding it along its sub frame support via the slide unit 14. The lower retracted position 2" of the table 2" is best illustrated in FIGS. 1 and 4.

The table in the lower retracted position 2" may be locked in place by further slide bolts 23.

In the lower retracted position 2" of the table an operator can easily reach the heads 4 in order to place a tubular workpiece (not illustrated) in a respective hoop 24 of a head 4 to hold the workpiece in place.

In order to return the table to its upper position, the table is pulled along its sub frame 16 returning the table to its outer intermediate position whereat it can be raised via hydraulic cylinders 20 to its upper position and then locked in place via sliding bolts 8.

The table can be lowered or raised by an operator turning handle 26 on the main frame 22 to power in a known fashion the hydraulic cylinders 20.

The table lowering and raising means has been described as being at least partially manually operated, but it could be electrically operated, also it has been described as hydraulic but could be pneumatically operated.

The machine unit has been described as having six heads each individually having the capacity to sew a work piece, but the machine unit could have any number of heads. Also, the machine unit has been described as an embroidery machine, but could be a different type of sewing machine.

Figure 5:
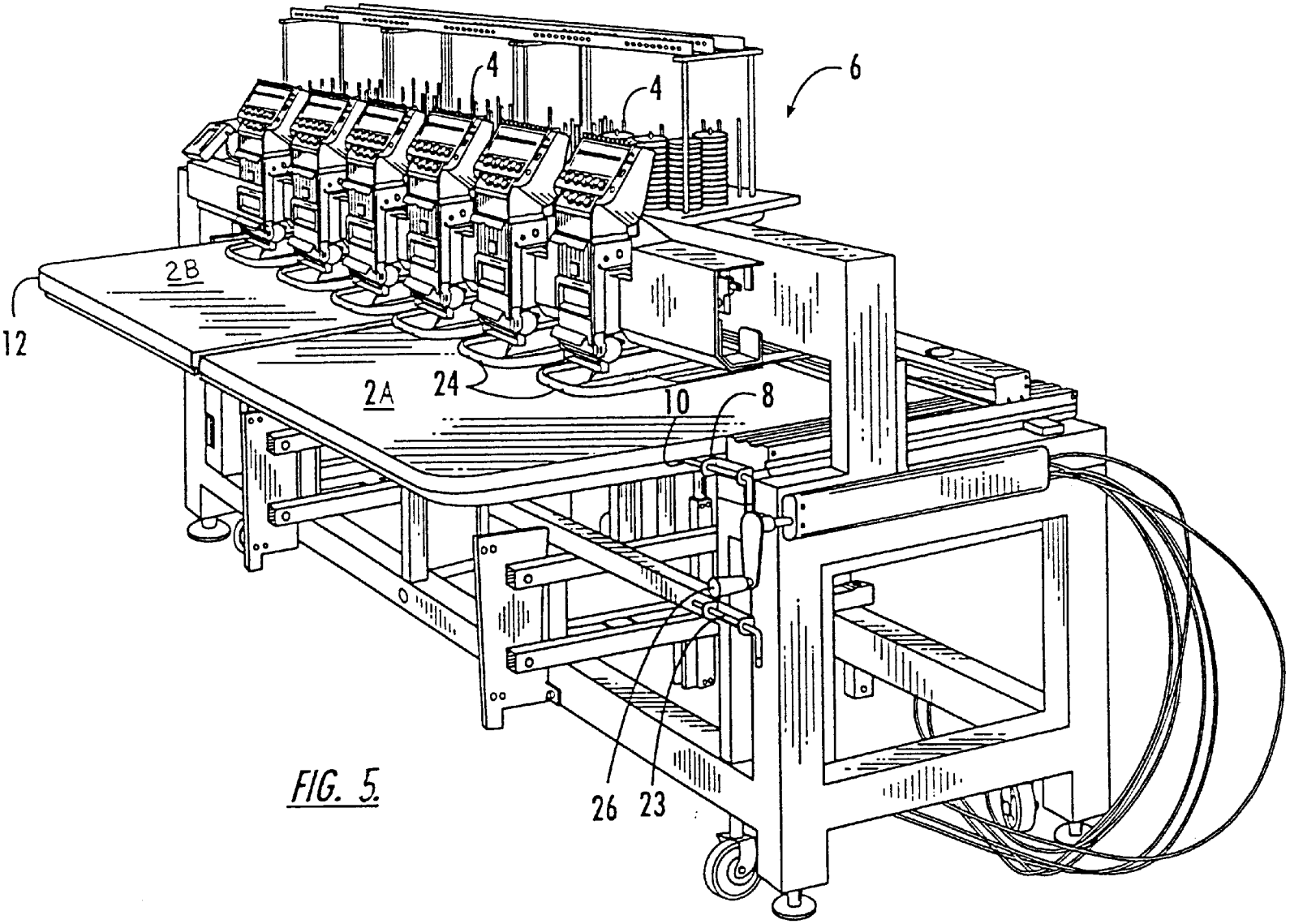
FIG. 5 is a perspective view of an alternative embodiment of the table having a split table surface with one surface raised and one surface lowered.

The table has been described as a single unit but could be provided in separate sections each independently retractable into the machine unit to allow individual heads or groups of heads of the machine unit to perform separate tasks. Such an alternative table is illustrated in FIG. 5 with the separate table sections being labeled 2a and 2b. Also the table has been described as being retractable in a lower position of the table, but the table could also be retractable in or alternatively in the upper position of the table to allow easier access to the work area, the table being slidable into the machine unit to allow clear access to the heads to allow tubular work pieces to be placed thereon, or to allow a reduced surface area on the table top for smaller flat work pieces. Also, the table may be folded or rolled out of the work area.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A work table for sewing machines comprising:

a main frame having lower frame portion and an upper frame portion, said main frame further having a longitudinal axis;

a sub frame;

a guide unit movably interconnected between the main frame and the sub frame said guide unit being operative for guiding movement of said sub frame relative to the main frame;

a table unit extending in a horizontal plane;

a slide unit slidably interconnected between said table unit and said sub frame so that said table unit is slidably mounted to the sub frame, said table unit being operative for linear sliding movement relative to said sub frame in a direction perpendicular to said longitudinal axis of said main frame;

a plurality of sewing machine units mounted on said upper frame portion of said main frame, said plurality of machine units mounted in side by side relation extending along the longitudinal extent of said upper frame portion so as to be positioned over said table unit parallel to said longitudinal axis of said main frame, said sub frame being movable between an upper position wherein the table unit is positioned in a first work area directly beneath said sewing machine units and a lower position wherein the table unit is positioned in a second work area spaced away from said sewing machine units, said table unit being slidably movable between a retracted position wherein the table unit is partially retracted into the main frame, and an extended position;

a locking mechanism for selectively locking the table unit in a desired position.

2. The work table as claimed in claim 1 wherein said guide unit comprises a linear slide unit slidably interconnected between said sub frame and said main frame such that said sub frame is vertically movable relative to said main frame between said upper and lower positions, said work table further comprising a lifting apparatus interconnected between said main frame and said sub frame for selectively moving said sub-frame between said lower position and said upper position.

3. The work table as claimed in claim 2 wherein said lifting apparatus comprises a hydraulic lifting system.

4. The work table as claimed in claim 3 wherein said hydraulic lifting system is manually operated by a handle.

5. The work table as claimed in claim 2 wherein said locking mechanism locks said table unit while said table unit is positioned in said first work area.

6. The work table as claimed in claim 1 wherein said locking mechanism comprises a slide bolt mounted to said main frame, said slide bolt being engageable with an opening in said table unit.

7. The work table as claimed in claim 1 wherein said table unit comprises first and second panel sections, each of said first and second panel sections of said table unit being movable between a retracted position and an extended position.

8. The work table as claimed in claim 7 wherein said locking mechanism comprises a slide bolt mounted to said main frame, said slide bolt being engageable with an opening in said table unit.

9. The work table as claimed in claim 7 wherein said locking mechanism comprises a slide bolt mounted to said main frame, said slide bolt being engageable with an opening in said table unit.

10. The work table as claimed in claim 7 wherein said locking mechanism comprises a slide bolt mounted to said main frame, said slide bolt being engageable with an opening in said table unit.

* * * * *